US005930863A

United States Patent [19]

Samuelsson

[11] Patent Number: 5,930,863

[45] Date of Patent: Aug. 3, 1999

[54] QUICK RELEASE SQUEEGEE

[76] Inventor: Soren Samuelsson, 74-259 Candlewood St., Palm Desert, Calif. 92260

[21] Appl. No.: 08/923,952

[22] Filed: Sep. 5, 1997

[51] Int. Cl.[6] ..... A47L 1/06

[52] U.S. Cl. ..... 15/245; 15/144.1; 15/145; 15/245.1

[58] Field of Search ..... 15/245, 145, 236.01, 15/245.1, 117, 121, 144.1; 30/329, 335, 336, 337, 338

[56] References Cited

U.S. PATENT DOCUMENTS 3,892,005 7/1975 Berns .
4,611,363 9/1986 Samuelsson .
4,697,296 10/1987 Smahlik .
4,777,694 10/1988 Young .
4,847,938 7/1989 Unger .
5,175,902 1/1993 Samuelsson .
5,458,060 10/1995 Casl ..... 15/245
5,494,478 2/1996 Long et al. ..... 452/127

*Primary Examiner*—Robert Warden
*Assistant Examiner*—Kaj K. Olsen
*Attorney, Agent, or Firm*—Fulwider Patton Lee & Utecht, LLP

[57] ABSTRACT

A squeegee including co-extensive stationary and moveable jaws joined medially by a fulcrum pin about which such moveable jaw is rocked by means of a lever arm handle.

5 Claims, 3 Drawing Sheets

FIG. 3
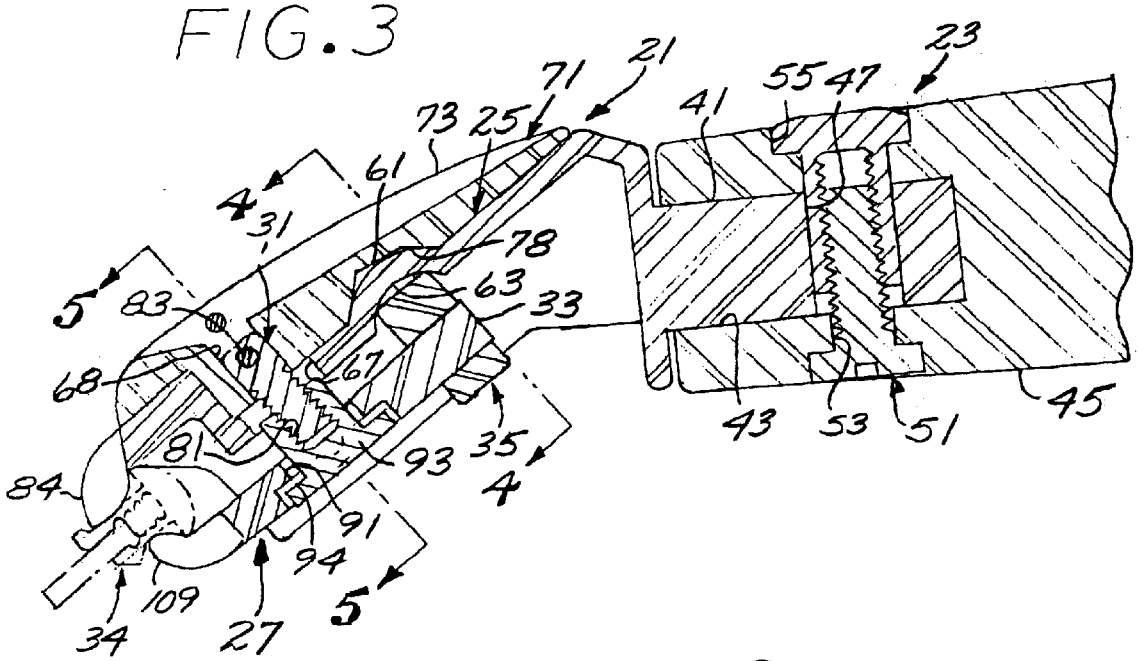
FIG. 4
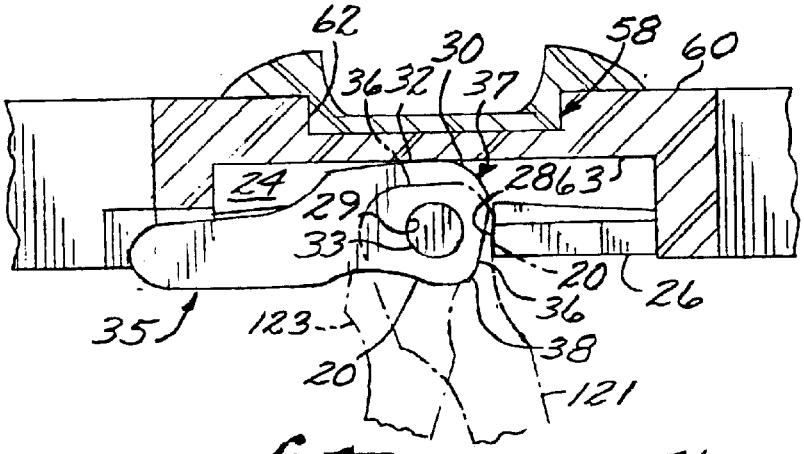
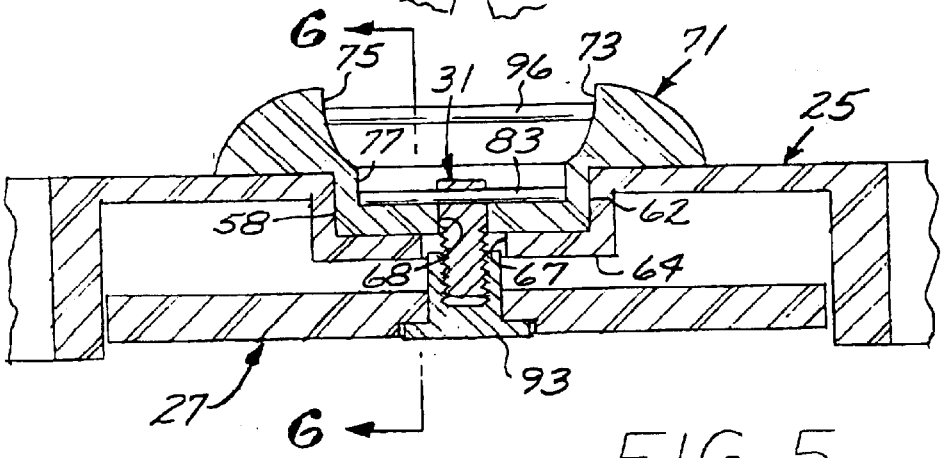
FIG. 5

QUICK RELEASE SQUEEGEE

BACKGROUND OF THE INVENTION

1. Field of the Invention

The present invention relates to a holder for holding a squeegee blade utilized for cleaning windows and the like.

2. Description of the Prior Art

Squeegees are utilized by window cleaners and the like for cleaning windows. Work is involved in the cleaning of, for instance, high density commercial and residential buildings typically worked from a scaffold or the like. The surface of the window is moistened with, for instance, water and water residue wiped therefrom by a flexible squeegee blade thus removing the dirt and residue from the window surface.

Professionals are typically contracted and endeavor to perform the cleaning process in a rapid manner. The squeegee blades typically become worn or damaged after extended use thus requiring removal and trimming or removal and replacement. Since time is of the essence and the blade exchange process typically takes place during the busy day of the professional, it is important that the holder for such squeegee blade incorporate an arrangement for release and securement of the blade by an approach which requires minimal dexterity and physical challenge. It is also important that the holder have a large bight for receiving blades of different sizes and shapes.

Many efforts have been made to provide a satisfactory squeegee holder. Representative of some early work is a holder having a pair of opposed jaws held together by a threaded bolt having a wing nut thereon for tightening purposes. A device of this type is shown in U.S. Pat. No. 3,110,052 to H. B. Whitman. Such devices are not generally accepted for professional usage since manipulation of the wing nut typically causes irritation to the user's fingers and the utilization of tools, such as pliers, is generally discouraged, particularly from a location high over a sidewalk on the scaffold.

Other attempts to provide a satisfactory squeegee proposed use of a releasable clamp. Such a device is shown in U.S. Pat. No. 3,892,005 to Berns. This device has not gained general commercial acceptance because the clamp is difficult to operate.

Other devices proposed for holding squeegee blades includes a squeegee formed with a forwardly projecting main jaw and a moveable jaw coextensive therewith and formed on its rear extremity with a fulcrum. The moveable jaw is joined to the main jaw by a threaded fastener including an adjustable nut on one end and a triangular shaped lever clamp on the top for drawing the jaws together about the rearwardly disposed fulcrum. A device of this type is shown in U.S. Pat. No. 4,697,296 to Smahlik. Devices of this type, while satisfactory for holding some squeegee blades, suffer the shortcoming that the configuration thereof provides for only a limited degree of jaw opening thus limiting the width of blade that can be held thereby. Moreover, the tightening lever is disposed on top of the upper jaw exposed for accelerated release by engagement with objects such as brushes or the like. Such lever has proven to provide relatively uneven operation forces and is generally uncomfortable to use for repeated manipulation by the window washer's fingers.

Another example of a prior squeegee cleaning device is a handle having a moveable jaw secured to a stationary jaw by means of a spring clip. A device of this type is shown in U.S. Pat. No. 3,892,005 to Berns. Devices of this type have not been generally accepted by professional window washers since the construction is relatively flimsy and operation of the tightening screw time consuming and generally requiring a screwdriver or other tool or manipulation thereof.

Further examples of the prior art includes squeegees having jaws moveable relative to one another and manipulated by rotary locking elements having locking buttons selectively registrable, upon rotation thereof, with detentes in a mating jaw to thereby allow for release of the jaw. A device of this type is shown in U.S. Pat. No. 4,777,694 to Young. Such devices, while satisfactory for holding a squeegee blade, have a limited range of motion, thus limiting the thickness of a blade that can be received between the clamping jaws and also provide only a limited amount of clamping force.

Thus there exists a need for a squeegee which is durable, easy to operate and has the capability of accepting blades of various thicknesses with an effective clamping force.

SUMMARY OF THE INVENTION

The present invention is characterized by a squeegee having a movable jaw rotatably tethered to a stationary jaw by means of a fulcrum pin such that the moveable jaw can be rocked around the fulcrum pin by means of a quick release lever handle carried rotatably from the rearward extremity of such moveable jaw and raisable to a release position to rotate a cam to open and close such jaw.

In one embodiment the forward extremity of the moveable jaw is biased away from the stationary jaw by means of compression springs. The fulcrum pin may incorporate screw threads mounting an adjustment screw which may be adjusted to vary the spacing between the front extremity of the jaws when the jaws arc in their closed position. The lever handle may project laterally of the longitudinal axis of the squeegee.

Other objects and features of the invention will become apparent from consideration of the following description taken in conjunction with the accompanying drawing.

BRIEF DESCRIPTION OF THE DRAWINGS

FIG. 3 is a longitudinal sectional view, in enlarged scale, taken along the line 3—3 of FIG. 1;

FIG. 4 is a transverse sectional view taken along the line 4—4 of FIG. 3;

FIG. 5 is a vertical sectional view taken along the line 5—5 of FIG. 3;

DESCRIPTION OF THE PREFERRED EMBODIMENT

Figure 1:
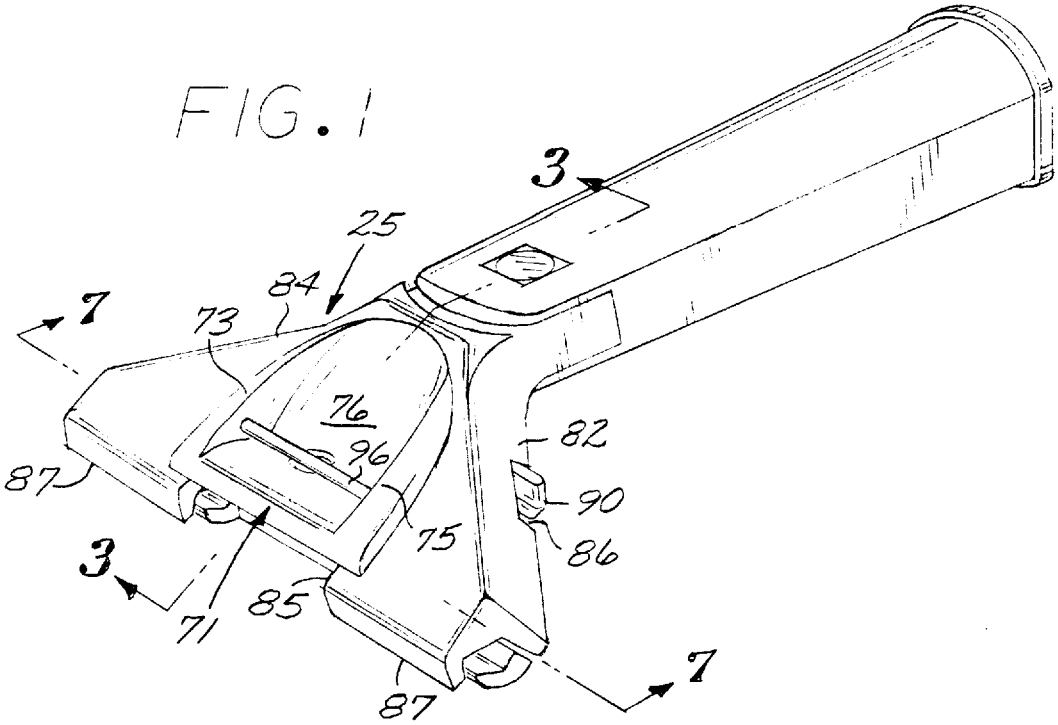
FIG. 1 is a perspective view of a squeegee incorporating the present invention.

Referring to FIGS. 1 and 3, the squeegee of the present invention includes, generally, a squeegee head 21 mounted on a handle 23 and configured with a forwardly projecting stationary upper jaw 25 having a moveable lower jaw 27 mounted thereunder. The moveable jaw 27 is mounted medially to the stationary jaw 25 by means of a threaded fulcrum pin, generally designated 31. Such lower jaw is formed on its rear extremity with a rearwardly projecting, cylindrical axle pin 33 which rotatably mounts one end of a recessed quick release lever, generally designated 35 (FIG. 4). The release lever 35 is formed on its proximal end with a cam, generally designated 37, defining a compound curve. When the lever is rotated to its recessed and closed position shown in FIG. 4, it is effective to rock the forward extremity of the bottom jaw 27 upwardly to draw it against the squeegee blade, generally designated 34. At the open position shown in FIG. 8, the jaws are spaced apart for release of the blade 34.

The squeegee holder shown in the preferred embodiment is of generally plastic construction and is fabricated by molding. Referring to FIG. 3, the stationary jaw 25 is configured with a rearwardly projecting tongue 41 received in a clevis 43 formed in the front extremity of a handle 45. The stem includes a cross bore 47 for receipt of a fastener bolt assembly, generally designated 51, which is received in counter sunk bores 53 and 55 formed in such handle.

Figure 2:
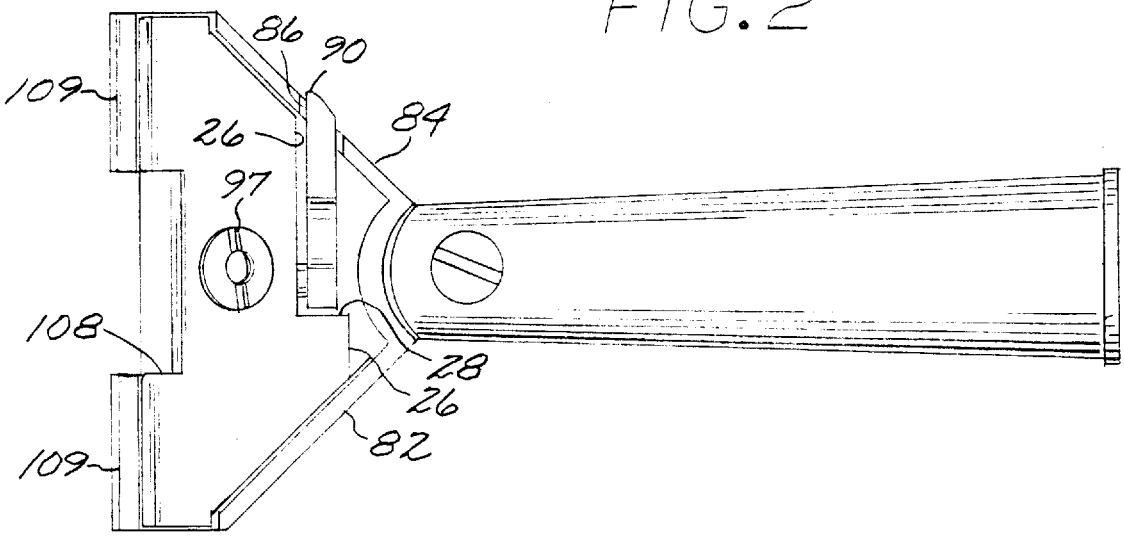
FIG. 2 is a bottom view of the squeegee shown in FIG. 1.

The jaw 25 is generally fan shaped and projects generally downwardly and forwardly at an angle of about 30° to the axis of the handle 23 and is formed with a planar top wall 60 configured on the lateral angular sides with respective outwardly flared skirts 82 and 84 (FIGS. 1 and 2). The skirt 82 is formed centrally with a lateral, downwardly opening clearance notch 86 for passage of the thumb tab at distal end 90 of the lever 35. Such jaw is formed at its forward extremity with a down turned lip defining laterally spaced apart gripper hooks 87 curved to complementally fit a curved bead formed on the back edge of a blade 34 (FIG. 3), such hooks being separated by a central slot 85 (FIG. 1). Such top wall is formed centrally with a downwardly recessed, longitudinally extending depression forming on its top side with a centrally disposed upwardly opening, generally rectangular in plan view, recess 62 and on its bottom side a rectangular downwardly facing platen 64 (FIG. 5). Formed in the bottom wall of such recess is a transversely projecting, upwardly raised rib 61 that forms on its underside a semi-cylindrical, laterally projecting groove 63 which forms a cam surface for cooperation with the cam 37 of the actuation lever 35. Formed centrally in such recess toward the front end thereof is a longitudinal slot 67 (FIGS. 3 and 5) for passage of the fulcrum pin 31.

A semi-oval in plan view cover plate, generally designated 71, overlies the recess and is configured at its opposite lateral edges with upwardly flared side flanges 73 and 75 and on its bottom side with a generally rectangular longitudinal, downwardly depending tongue 58 received in the depression 62. Such cover plate is formed forwardly with an oversize through fulcrum pin bore 68 (FIG. 5) and has an upwardly opening diametrical slot 77 aligned therewith for nesting thereto of a diametrical hinge pin 83 which pierces the head of the fulcrum screw to form a T-configuration for suspending such screw from the cover plate. The bottom side of such plate is formed with a transverse groove 78 which nests over the rib 61 (FIG. 3). The flanges 73 and 75 are formed with inwardly opening blind bores for receipt of the opposite ends of a tether rod 96 disposed in blocking arrangement over the fulcrum pin to hold it captive in such cover plate.

The lower jaw 25, in bottom plan view, is generally in the shape of an equilateral trapezoid (FIG. 2) to be received within the confines of the side skirts 82 and 84 (FIGS. 1 and 2). Such jaw is formed at its forward extremity with a pair of upturned lips defining respective curved gripper hooks 109 flanking clearance gap 108 and confronting the respective hooks 87 to embrace the opposite sides of the bead formed by the blade 34 (FIG. 3). Such jaw is formed at its rear extremity to cooperate in spaced relationship with the jaw 25 to form a lever receiving cavity 24 (FIG. 4) and is further formed at the bottom of such cavity with a lateral, rearwardly opening clearance notch 26 having the centrally disposed rearwardly projecting constant diameter cylindrical pin 33 which is frictionally engaged in a bore 29 formed in the actuating lever 35. Projecting rearwardly in flanking relationship with the pin 33 and defining the interior end of such notch is a flange 26 formed at its interior end with an abutment edge 28 (FIG. 2) spaced a selected distance from the axis of such pin to cooperate with the lever 35 as described below. Formed centrally in such jaw is a countersunk bore 91 aligned with the slot 67 to receive a shoulder adjustment nut 93 screwed onto the bottom extremity of the threaded fulcrum pin 31.

Such bore is formed with a downwardly facing annular shoulder 94 (FIG. 3) having formed at the diametrical lateral sides thereof stub ribs (not shown) which space the confronting shoulder of the head of the nut 93 slightly from the downwardly facing surface of the bore shoulder 94 to maintain such floating jaw free to rock about a lateral axis defined thereby. The shoulder nut 93 is formed with a downwardly opening cross slot 97 (FIG. 2) configured for receipt of the blade of a screwdriver or, for instance, the edge of a coin, such as a quarter.

Figure 6:
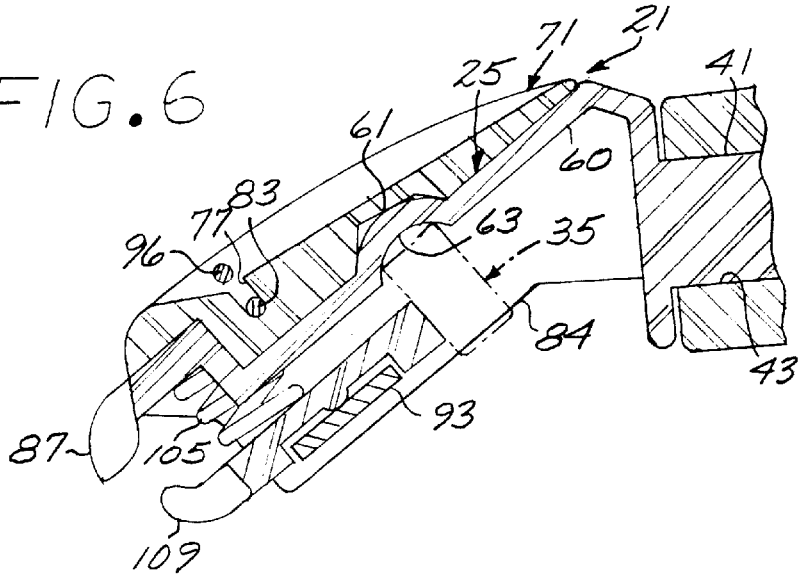
FIG. 6 is a longitudinal sectional view taken along the line 6—6 of FIG. 5.
Figure 7:
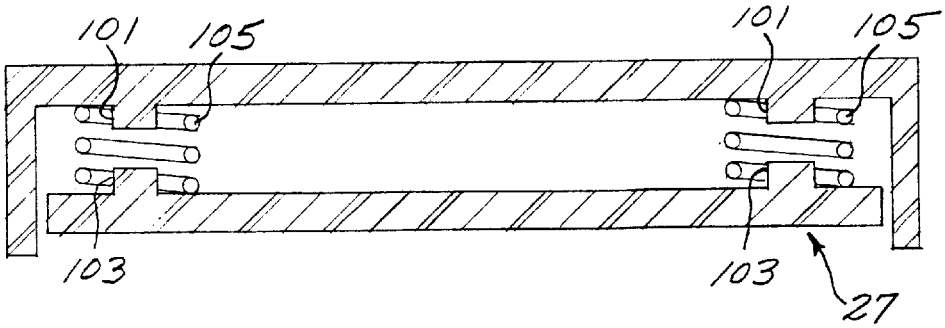
FIG. 7 is a transverse sectional view, in enlarged scale, taken along the line 7—7 of FIG. 1.
Figure 8:
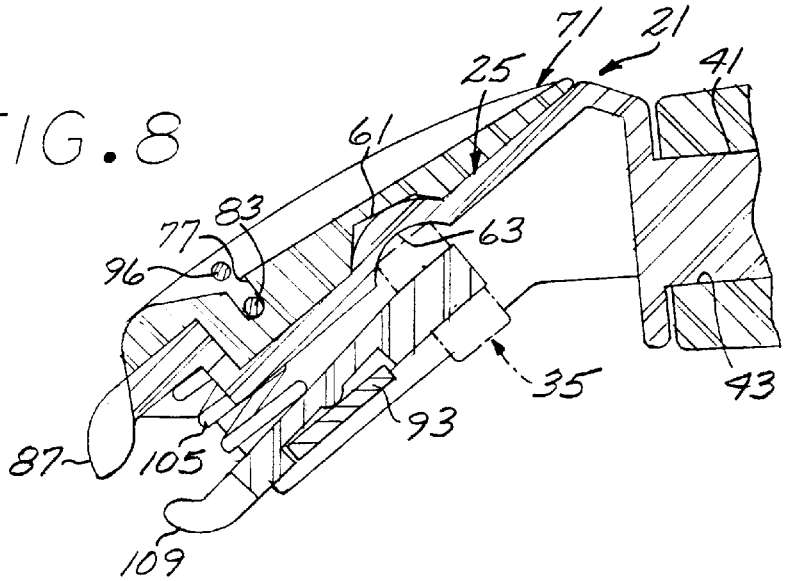
FIG. 8 is a longitudinal sectional view similar to FIG. 6 but showing the jaws in their full open position.

Referring to FIGS. 6–8, the jaws 25 and 27 are formed forwardly with pairs of confronting strut posts 101 and 103 which receive thereover the respective opposite ends of compression coil springs 105 to thus bias the forward extremity of the jaw 27 away from the forward extremity of the stationary jaw 25.

Referring to FIG. 4, the lever handle 35 is constructed of plastic and is configured on its proximal end about the bore 29 with the cam 37 formed with a compound contour to define a laterally disposed upwardly facing, generally flat, clamp surface 32 spaced a maximum distance from the axis of the axle pin 33. Progressing clockwise about such cam 37, an intermediate release nub 30 is formed to the right of the surface and has an apex disposed at about 45° to the longitudinal axis of the lever and disposed at an intermediate distance from the axle pin. The cam surface then angles, as viewed in FIG. 4, downwardly and to the left at an angle of about 40° to the horizontal to thereby form a flat open cam surface 36 spaced a minimum distance from the center of the pin 33 to thereby co-act with the cam slide surface 63 to provide for a maximum spacing of the jaws relative to one another as described hereinbelow. Formed on such lever opposite the flat surface 36 is a clearance cut out formed on one end with an interference control surface 20 spaced from the center of the axle pin 33 a distance sufficient to cause a slight interference engagement with the abutment edge 28 upon rotation of the lever 35 to its intermediate position shown in broken lines at 123 (FIG. 4).

It will be appreciated that the squeegee of the present invention is particularly inexpensive to manufacture and assemble. For instance, the jaws 25 and 27, as well as the lever handle 35, may be constructed by plastic molding. The lever 35 may be mounted on the lower jaw by fitting the bore over the axle pin 33 to be held frictionally in place for selective rotation. The cover plate 71 may also be preassembled by positioning the T-shaped fulcrum pin 31 and hinge pin 83 in position with the pin projecting through the oversized bore 68 and the hinge pin 83 nested in the slot 70 (FIG. 5). The tether bar 96 may be inserted in bores formed in the flanges 73 and 75 and, if desirable, the end of such bore closed by, for instance, a plastic weld. The preassembled cover plate 71 may then be positioned on the stationary jaw 25 with the tongue 58 nested in the recess 62 and the shank of the fulcrum pin received in the slot 67 to be positioned in alignment with the countersunk bore 91 in the moveable jaw 27. The rest of the assembly may then be made by merely inserting the respective one ends of the coil springs 105 in position over the stub post 101 (FIG. 7) and positioning the lower jaw 27 in underlying relationship on the platen 64 (FIG. 5) with the bottom end of the fulcrum pin received in the bore 91. The shoulder adjustment nut 93 may then be screwed onto the lower extremity of such fulcrum pin to form a fulcrum linkage to hold the lower jaw in floating relationship with the upper jaw so that its movement will be defined by manipulation of the lever 35.

In operation, the adjustment nut 93 is typically adjusted at the factory to set the grabber hooks 87 and 109 at a spacing to accommodate the width of a selected blade 34. The blade shown is of the type manufactured by Sorbo Products of Palm Desert, Calif. and includes a grasp backing channel as disclosed in my U.S. Pat. Nos. 4,611,363 or 5,175,902.

When the squeegee is to be used, the window washer may first tie a safety tether to the tether bar 96, make final adjustment of the adjustment nut 93 or may adjust the squeegee to fit, for instance, a blade of a configuration somewhat different than that of the blade 34. In any event, the blade will be positioned between the forward extremities of the jaws 25 and 27 to be grabbed by the grabber hooks 87 and 109 as the jaws are clamped downwardly thereon. Clamping of the jaws to their closed position is accomplished by rotating the quick release lever 35 to the retracted solid line position recessed within the cavity 24 (FIG. 4) to thus position the clamping cam surface 32 between the cam bearing surface 63 and the axle pin 33 to thus rotate the lower jaw 27 clockwise as viewed in FIG. 3, disposed the greatest diametrical distance from the axle pin, as allowed by articulation of the fulcrum pin 31, to thus press the pair of grabber hooks 87 and 109 firmly inwardly on the opposite sides of the blade 34. Further adjustment of the jaws may be achieved by inserting the edge of a quarter into the adjustment slot 97 (FIG. 2) and rotating the adjustment nut 93 to tighten it down on the fulcrum pin 31 to draw the moveable jaw 27 further clockwise about the contact point of the cam surface 32 on the bearing surface 63 as allowed by the fulcrum pin 31. Typically, the nut 93 is tightened to the point where the grabber hooks 87 and 109 firmly clamp onto the opposite sides of the blade 34 with sufficient force to hold it firmly in position but yet allow for the workman to, with a firm tug on such blade, draw it laterally to one side or the other of the squeegee for positioning thereof.

The workman may then use the squeegee to wash windows by wiping the blade 34 across the surface. It will be appreciated by those skilled in the art the lever 35 is maintained generally recessed in the cavity 24 (FIG. 4). This, coupled with the fact such lever is on the bottom of the squeegee, protects it from accidental contact with obstructions adjacent the window being washed and encountered by the top side of such squeegee and minimizes the risk of accidental engagement by the operator and dislodgement from its locking position.

In the event the workman desires to remove the blade 34 for replacement or trimming, this may be quickly achieved by engaging the thumb tab 90 (FIG. 1) and rotating the quick release lever 35 counterclockwise downwardly to the full release position as depicted in FIG. 4 by the broken lines 121 to position the opening flat cam surface 36 in engagement with the slide surface 78 allowing the lower jaw to rotate fully counterclockwise as viewed in FIG. 3 to its full open position to release the blade 34. This allows the coil springs 105 to press the jaw 27 in such counterclockwise direction a distance sufficient to spread the jaws to the bite position shown in FIG. 8 thereby affording sufficient clearance so the blade 34 may be drawn directly forwardly and be released from the clamping action of such jaws for removal of such blade and possible replacement by another blade.

In particular applications, the workman may want to release the force on the jaws to a sufficient degree to maintain a relatively light clamping force on the blade 34 to hold it gently in position within the grabbers 87 and 109 yet allow for relatively free lateral movement thereof relative to such grabbers. In this instance, the workman may engage the free end 90 of the lever 35 with his thumb or finger and rotate it counterclockwise from its locking position as viewed in FIG. 4 to the intermediate position depicted by the broken lines 123 thereby disposing the release nub 30 (at the intermediate radial distance from the axis of the pin) between the axle pin 33 and the slide surface 63 thereby allowing the springs 105 to spread the front extremities of the jaws apart to an intermediate position lightly gripping the blade but with insufficient force to prevent convenient drawing of such blade to one side or the other. The blade can then be adjusted laterally in that manner without risk of the blade falling free in the forwardly direction. The workman may then rotate the lever 35 clockwise as shown in FIG. 4 to its clamping position depicted in solid line to clamp the adjusted blade firmly in place as he or she continues with the window washing work.

Should the workman inadvertently grasp the thumb tab 90 when the lever 35 is in a generally vertical position and endeavor to rotate such lever in a longitudinal plane, such lever is free to overcome the friction and slide on the axle pin to slide free thereof thus preventing any permanent damage that could otherwise be imposed.

From the foregoing, it will be appreciated that the squeegee apparatus of the prevent invention provides an inexpensive, convenient and highly reliable means for releasably holding a squeegee blade. The jaws have a sufficiently wide bite to accommodate blades of numerous different thicknesses and configurations and can be opened to the point where the blade may be removed forwardly from the jaws without lateral sliding. The clamping forces generated by the squeegee are sufficient to securely hold various different blades in position. The squeegee device incorporates an intermediate release position which conveniently allows the workman to adjust the blade laterally while being retained in the jaws.

Various modifications and changes may be made with regard to the foregoing detailed description without departing from the spirit of the invention.

What is claimed is:

1. A squeegee for removably holding a squeegee blade comprising:

a squeegee body including a forwardly projecting stationary jaw device formed with a rearward portion, an intermediate portion, and a forward extremity configured with a first clamp element for engaging one side of said blade;

a floating jaw co-extensive with said stationary jaw and formed with a rearward section, a medial section, and a forward end formed with a second clamp element for engaging the side of said blade opposite said one side;

said stationary jaw device is fan shaped in top plan view and configured with a downwardly depending, forwardly and outwardly flared vertical skirts defining therebetween a cavity, one of said skirts being formed with a clearance notch;

said floating jaw is trapezoidal shaped in bottom plan view and configured for complemental receipt in said cavity;

a fulcrum pin connecting one of said portions to one of said sections for pivoting of said floating jaw relative to said stationary jaw from a release to a clamping position;

a lever rotatably mounted on one of the other of said sections or portions and including a cam interposed between said stationary jaw device and floating jaw to, upon said lever being rotated from a first position to a second position, rotate said floating jaw from said release to said clamp position to drive said floating jaw and rotate it relative to said fulcrum pin to urge said second clamp element toward said first clamp element to be spaced a selected distance apart; and said lever is configured to project outwardly through said notch to terminate in a thumb tab.

2. A squeegee comprising:

a squeegee body including a forwardly projecting stationary jaw device formed with a rearward portion, an intermediate portion, and a forward extremity configured with a first clamp element;

a floating jaw co-extensive with said stationary jaw and formed with a rearward section, a medial section, and forward end formed with a second clamp element confronting said first clamp element;

said floating jaw and said stationary jaw device cooperating to form a lever retraction cavity, and said floating jaw being formed on one side of said cavity with an elongated notch;

a fulcrum pin connecting one of said portions to one of said sections to form a fulcrum linkage for pivoting of said floating jaw relative to said stationary jaw device from a release position to a clamping position;

a lever mounted on one end to one of said sections other than said section forming said fulcrum linkage, received in said cavity and rotatable from a clamping position nested in said cavity outwardly through said notch to an extended release position; and a cam section on one end of said lever interposed between said stationary jaw device and floating jaw to, upon said lever being rotated from said clamping position to said release position, rotate said second clamp element away from said first clamp element.

3. A squeegee as set forth in claim 2 wherein:

said stationary jaw device is formed on at least one lateral opposite side with a skirt projecting toward said floating jaw and cooperating to form one end of said lever retraction cavity.

4. A squeegee as set forth in claim 2 wherein:

said stationary jaw device and floating jaw are constructed of plastic.

5. A squeegee as set forth in claim 2 that includes:

compression springs interposed between said floating jaw and stationary jaw device for biasing said clamp elements away from one another.

* * * * *

UNITED STATES PATENT AND TRADEMARK OFFICE

CERTIFICATE OF CORRECTION

PATENT NO. : 5,930,863

DATED : July 27, 1999

INVENTOR(S) : Peter H. Plocher

It is certified that error appears in the above-indentified patent and that said Letters Patent is hereby corrected as shown below:

Column 3, line 48, after "switch" insert --circuit--.

Column 3, line 49, after "signals" delete "circuit".

Column 4, line 53, after "switch" insert --circuit--.

Column 4, line 54, after "signals" delete "circuit".

Column 5, line 14, after "switch" insert --circuit--.

Column 5, line 15, after "signals" delete "circuit".

Signed and Sealed this

Fourteenth Day of November, 2000

*Attest:*

*Attesting Officer*

Q. TODD DICKINSON

*Director of Patents and Trademarks*